US007766591B2

(12) United States Patent
Douglas

(10) Patent No.: US 7,766,591 B2
(45) Date of Patent: Aug. 3, 2010

(54) METHOD OF TRANSPORTING ROOF CONSTRUCTION PANELS

(75) Inventor: Bruce F. Douglas, Zionsville, IN (US)

(73) Assignee: BFS Diversified Products, LLC (US)

( * ) Notice: Subject to any disclaimer, the term of this patent is extended or adjusted under 35 U.S.C. 154(b) by 978 days.

(21) Appl. No.: 11/402,603

(22) Filed: Apr. 12, 2006

(65) Prior Publication Data

US 2007/0207001 A1 Sep. 6, 2007

Related U.S. Application Data

(60) Provisional application No. 60/778,122, filed on Mar. 1, 2006.

(51) Int. Cl.
*B65B 11/02* (2006.01)

(52) U.S. Cl. ..... 410/98

(58) Field of Classification Search ..... 410/32, 410/34, 97, 98, 100; 206/597, 425, 449, 206/484, 497; 414/501–503, 809; 53/397, 53/441, 442, 427, 463, 557

See application file for complete search history.

(56) References Cited

U.S. PATENT DOCUMENTS 4,492,071 A * 1/1985 Gibson
6,015,250 A * 1/2000 Walsh et al. ..... 410/100

* cited by examiner

*Primary Examiner*—Stephen Gordon
(74) *Attorney, Agent, or Firm*—Thomas R. Kingsbury

(57) ABSTRACT

A method of transporting insulation panels to a location, the method comprising providing a plurality of insulation panels; placing a predetermined number of said insulation panels into stacks, said stacks including a top surface, lateral sides and a bottom surface; covering said stack with a heat shrinkable material, wherein said heat shrinkable material covers said top surface and said lateral sides, at least a portion of said material extending below the intersection between said bottom surface and said lateral sides; heating said heat shrinkable material, thereby shrinking said heat shrinkable material substantially flush against said lateral sides; loading a plurality of stacks on a vehicle; and moving said vehicle with said plurality of stocks to the location.

33 Claims, 11 Drawing Sheets

METHOD OF TRANSPORTING ROOF CONSTRUCTION PANELS

This application claims the benefit of U.S. Provisional Application No. 60/778,122, filed Mar. 1, 2006.

FIELD OF THE INVENTION

One or more embodiments of the present invention are directed toward a method for transporting insulation panels.

BACKGROUND OF THE INVENTION

Construction insulation boards are used for a variety of purposes. One use is in the building construction industry, particularly to provide a heat barrier for flat or low slope roofs. These insulation boards are relatively low density materials and are thus susceptible to damage, particularly during shipment. In the past, several methods were adopted to protect the insulation boards during transmit. For example, in one method, a plurality of boards were vertically stacked and then circumferentially wrapped with a plurality of overlapping or partially overlapping plastic membranes. Other methods employed a type of resilient stretchable plastic bag which was stretched, disposed over the vertical stacks and then allowed to retract onto the stack to form bundles. In either case, the bundles were then loaded onto flat bed trucks for delivery.

These methods proved insufficient to protect the boards during transportation, particularly when the trucks traveled at highway speed. Most notably, the circumferential wrap or stretch plastic methods do not closely conform to the configuration of the stack of panels. Specifically, while these approaches provide adequate support to maintain the stacks in a secure bundle, exterior wrinkles or surplus material are formed. These wrinkles, particularly those proximate to the top of the bundles, experience tearing and other failures when battered by high winds during transmit. Consequently, the construction panels become exposed to water and wind damage which may render them unusable.

This problem was alleviated by first stacking the bundles on a flatbed truck and then applying a tarp over the entire load. While this approach was effective in preventing damage to the boards during transport, new issues arose. The tarping process required a driver to climb to the top of the stacked bundles to properly position and secure the tarp. This increased the risk of driver injury because the stacked bundles were dangerously high above the ground. Further, the application of a tarp required additional man hours, thus making it economically disadvantageous. Still further, the tarping requirement extends the time required for a truck to load and deliver a load of insulation board and requires building contractors to tarp loads for protection while on the job site, which adds additional cost to each project.

Thus, there exists a need in the art for an improved method of transporting insulation boards that is safer and more efficient, while still adequately protecting the insulation boards during transmit and at the job site.

SUMMARY OF THE INVENTION

One or more embodiments of the present invention provide a method of transporting roof insulation panels, the method comprising providing a stack of insulation panels, the stack including a top surface, a plurality of lateral sides and a bottom surface, covering the stack with a heat shrinkable material, wherein the material covers the top surface and the lateral sides, at least a portion of the material extending beyond the intersection between the bottom surface and the lateral sides, heating the material thereby shrinking the material substantially flush against the lateral sides, loading a plurality of stacks on a vehicle, and moving the vehicle with the plurality of stacks to the location.

One or more embodiments of the present invention also provides a method of transporting insulation panels, the method comprising providing a plurality of insulation panels, stacking the panels on a first conveyor, each the stack including a predetermined number of insulation panels, heat shrinking a cover on each the stack, attaching a spacer to a bottom surface of each the stack, loading a plurality of stacks on a truck, strapping the stacks to the truck, driving the truck to a construction site, removing the straps, and unloading the plurality of stacks from the truck.

DETAILED DESCRIPTION OF ILLUSTRATIVE EMBODIMENTS

In one or more embodiments, the method of this invention includes providing a stack of insulation panels and applying heat shrinkable wrap over the stack. Heat may be applied to the stack, which shrinks the wrap to closely conform to the exterior of the stack, thereby forming self-contained bundles. A plurality of spacers may be applied to a bottom surface of the bundles. The bundles may be placed on and secured to a transportation vehicle and transported without providing a tarp thereover.

Figure 1:
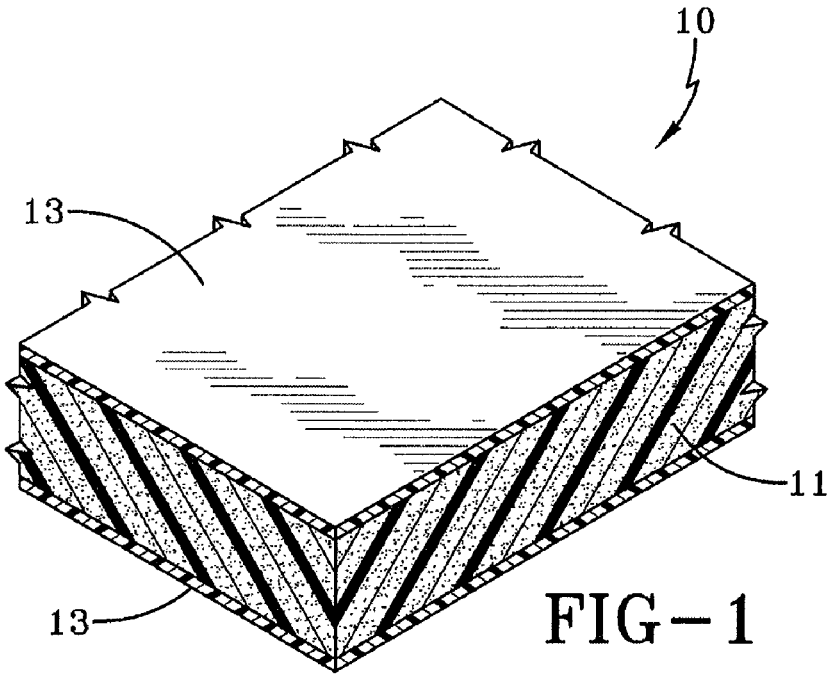
FIG-1 Prior Art
FIG. 1 is a fragmentary elevational view of an insulation panel of the type involved in the present invention.

The insulation panels 10, which may also be referred to as insulation boards or simply panels or boards, include those conventionally used in the construction industry such as those adapted for use in flat or low slope roofs. Referring to FIG. 1, a panel 10 may include a closed-cell foam core 11 and an exterior facer layer 13, which may be a polymer coated glass-fiber.

In one or more embodiments, panels 10 are formed from light weight materials. In other embodiments, panels 10 may include low density materials, wherein low density may be defined as a material having a density less than a solid. In one or more embodiments, panels 10 may be a foamed material. In one or more embodiments, the insulation panels include an isocyanate-based material. In still other embodiments, the panels 10 include polyurethane or polyisocyanurate. In still other embodiments, insulation panels 10 include closed-cell foams. The polymer coated glass-fiber may strengthen the board and promotes water resistance. In general, the above disclosed insulation panels are known in the art, as exemplified by the disclosures of U.S. Pat. No. 5,891,563 to Letts, U.S. Application No. 60/274,052 to Letts et al., U.S. application Ser. No. 10/632,343 to Letts et al., U.S. application Ser. No. 10/640,895 to Letts, U.S. Application No. 60/649,385 to Letts et al., and U.S. Application No. 60/586,424 to Letts, which are incorporated herein by reference.

Panels 10 may be formed from continuous sheets that are then cut to any number of shapes and sizes depending upon the desired final application. In one or more embodiments, panels 10 may be cut 4 feet wide and 4 feet long. In other embodiments, panels 10 may be cut 4 feet wide and 8 feet long. Similarly, the thickness of panels 10 may vary depending upon building design specifications. In one or more embodiments, panels 10 may be from about ½" to about 4" thick. It should be appreciated that any combination of panel size and thickness may be manufactured, but for the remainder of this disclosure an exemplary board having a length of 8 feet, a width of 4 feet, and a thickness of 2 inches will be discussed and referenced in the figures.

Figure 2:
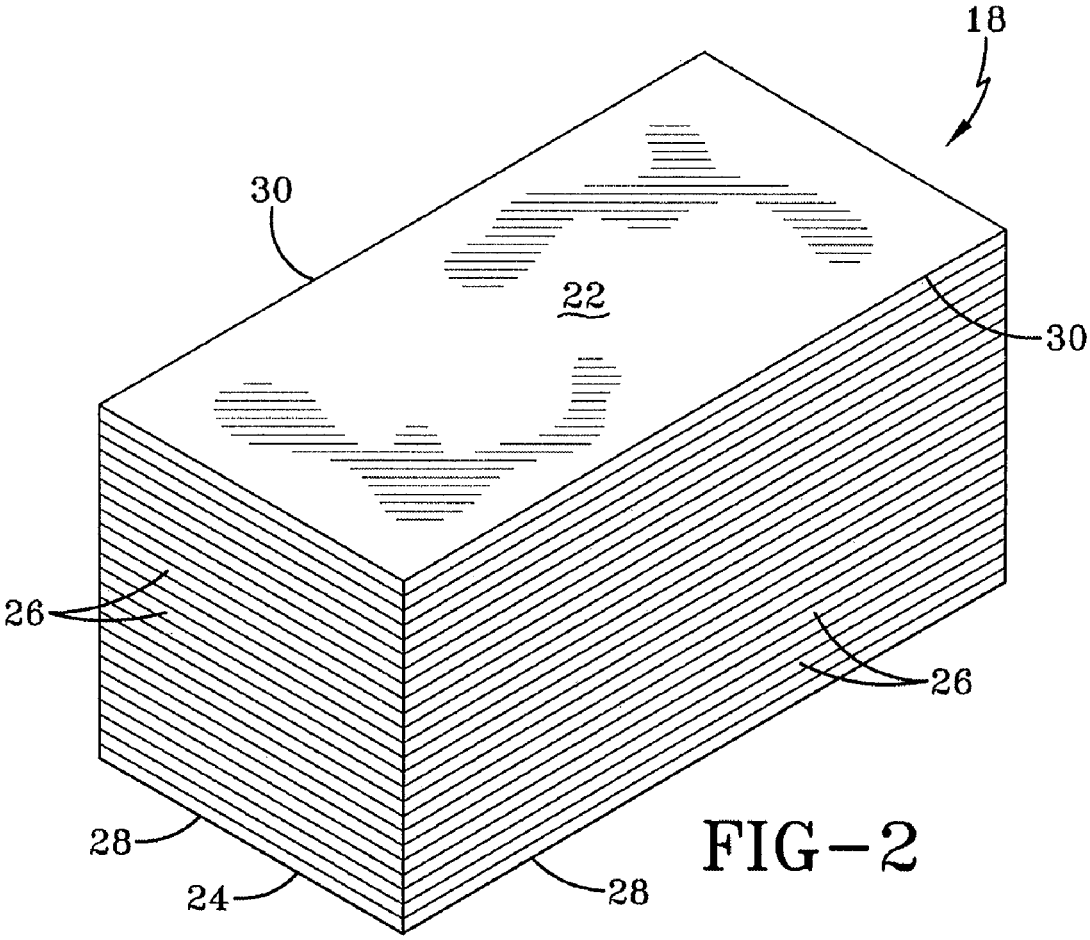
FIG. 2 is a perspective view of a stack of the panels of FIG. 1.
Figure 3:
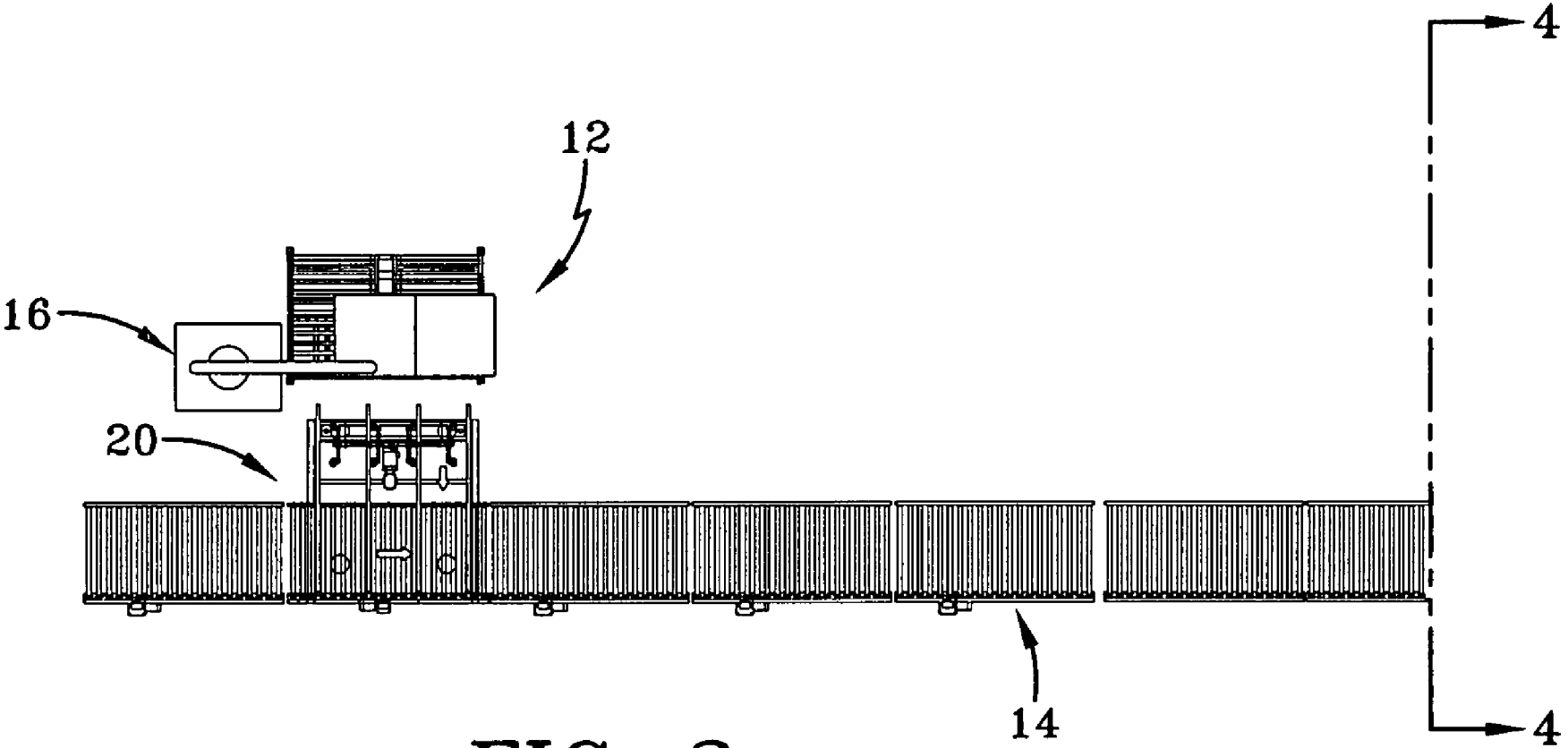
FIG. 3 is a fragmentary top schematic view of a portion of an exemplary factory line employed in the method of the present invention.
Figure 11:
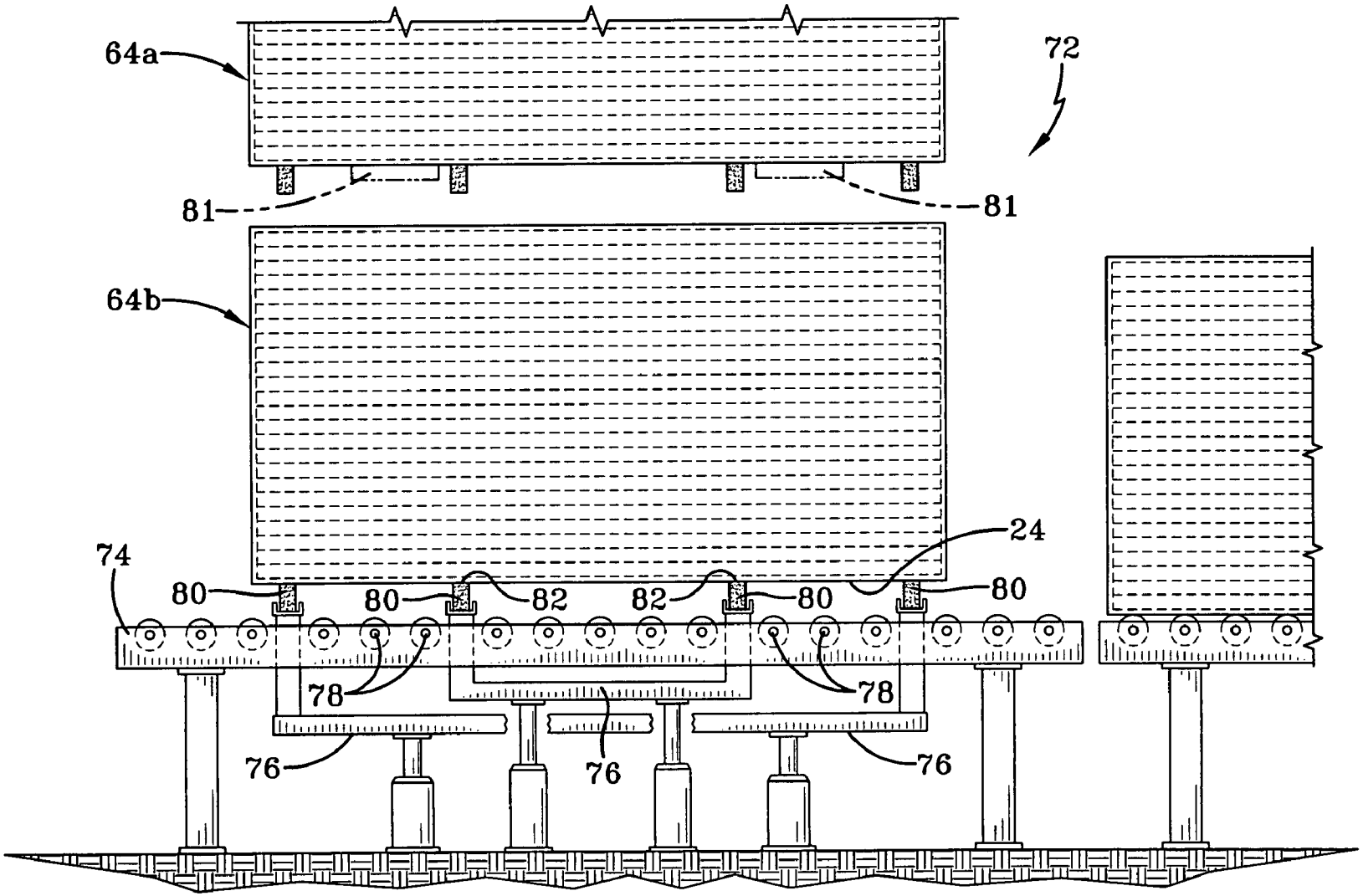
FIG. 11 is a side elevational view of a spacer application station.
Figure 12:
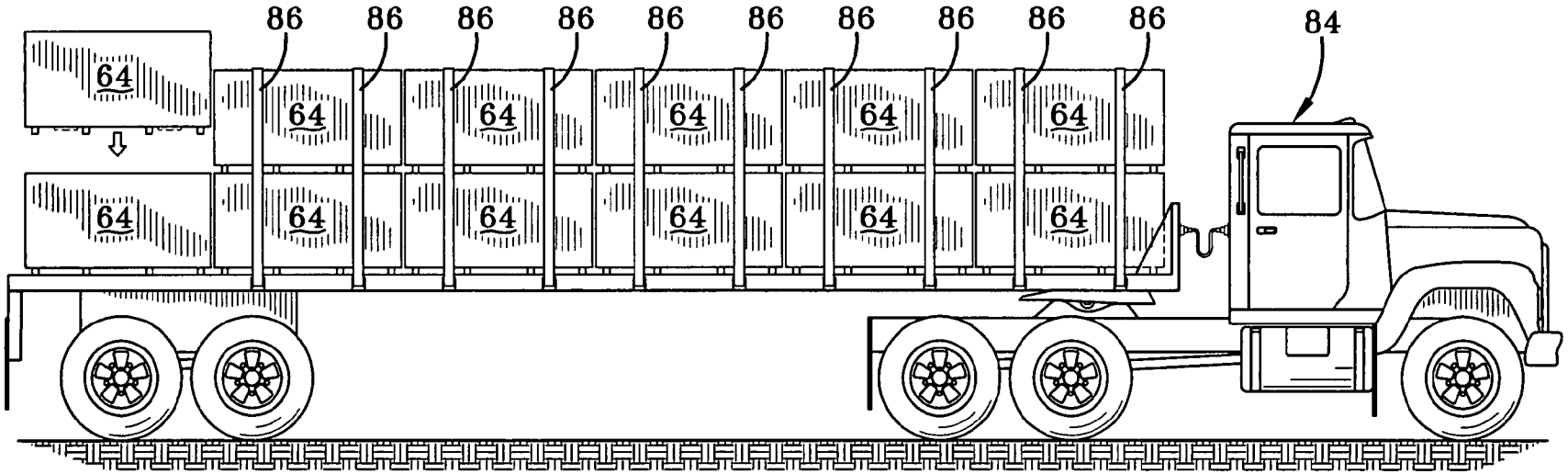
FIG. 12 is a side elevational view of a loaded truck.
Figure 13:
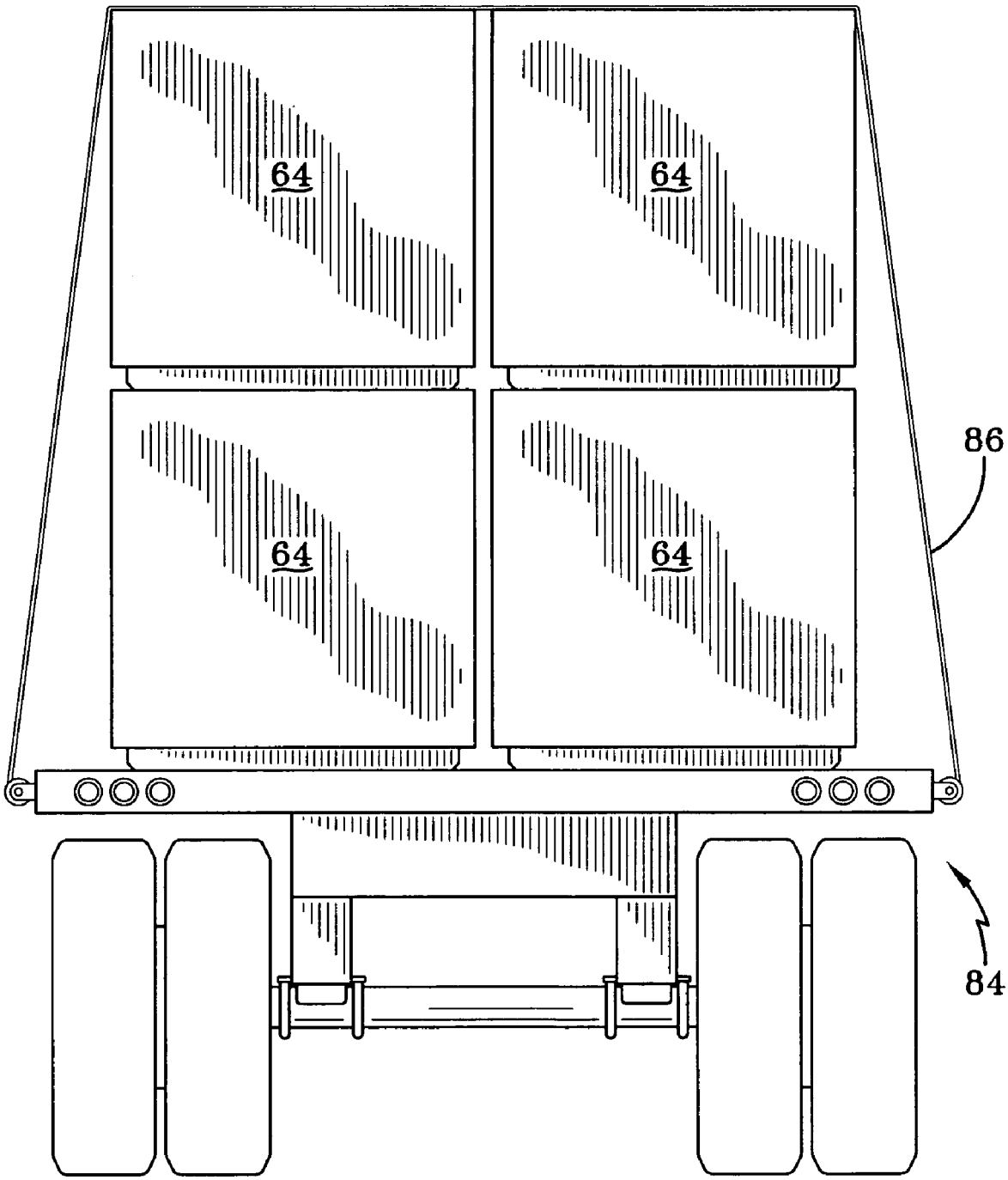
FIG. 13 is a rear elevational view of the loaded truck.

In preparation for shipment, it may be preferable that panels 10 be grouped in easily movable units and then provided with an exterior protective membrane. Thus, a predetermined number of panels 10 may be placed in a vertically aligned stack 18, as shown in FIG. 2. As shown in FIG. 3, stacks 18 may then be transported by conveyor to a heat shrink wrap station 36 that applies a tight, form fitting cover over the stack, thereby creating a self-contained bundle 64. As shown in FIG. 11, spacers 80 may then be applied to self-contained bundles 64, which may ease storage and provide additional protection. As shown in FIGS. 12-13, bundles 64 may then be shipped on a vehicle 84 without need for a tarp.

Referring now to FIGS. 2 and 3, panels 10 may be provided from the manufacturing area to a stacking station 12. Stacking station 12 receives panels 10, which may be delivered individually from the manufacturing area, stacks panels 10, and transfers panels 10 to a first conveyor 14. Stacking station 12 may employ any method to transfer and stack panels 10 on first conveyor 14. In one or more embodiments, a plurality of computer controlled robotic arms 16 may be employed to lift panels 10 and place them in vertically aligned stacks 18. In other embodiments, stacks 18 may be manually stacked by hand. Any number of panels 10 may be placed in a single stack 18, limited only by downstream vertical constraints (e.g. truck height). For example, if 2-inch thick panels 10 are in production, and the desired stack height is 48 inches, the robotic arms may place 24 panels in a single stack before advancing that stack 18 and beginning anew. In one or more embodiments, robotic arms 16 may stack panels 10 on one or more chain conveyors 20 that then transfer the stacks 18 to first conveyor 14 in a manner known in the art. In any event, stacking station 12 provides first conveyor 14 with stacks 18, each of which include a predetermined number of panels 10. First conveyor 14 may be powered, thereby transporting stacks 18 downstream to shrink wrap station 36 at a preset speed.

Each stack 18 includes a top surface 22, a bottom surface 24, and four lateral sides 26. A bottom edge 28 is defined at the intersection of the four lateral sides 26 and bottom surface 24. Similarly, a top edge 30 is defined at the intersection of the four lateral sides 26 and top surface 22.

Figure 4:
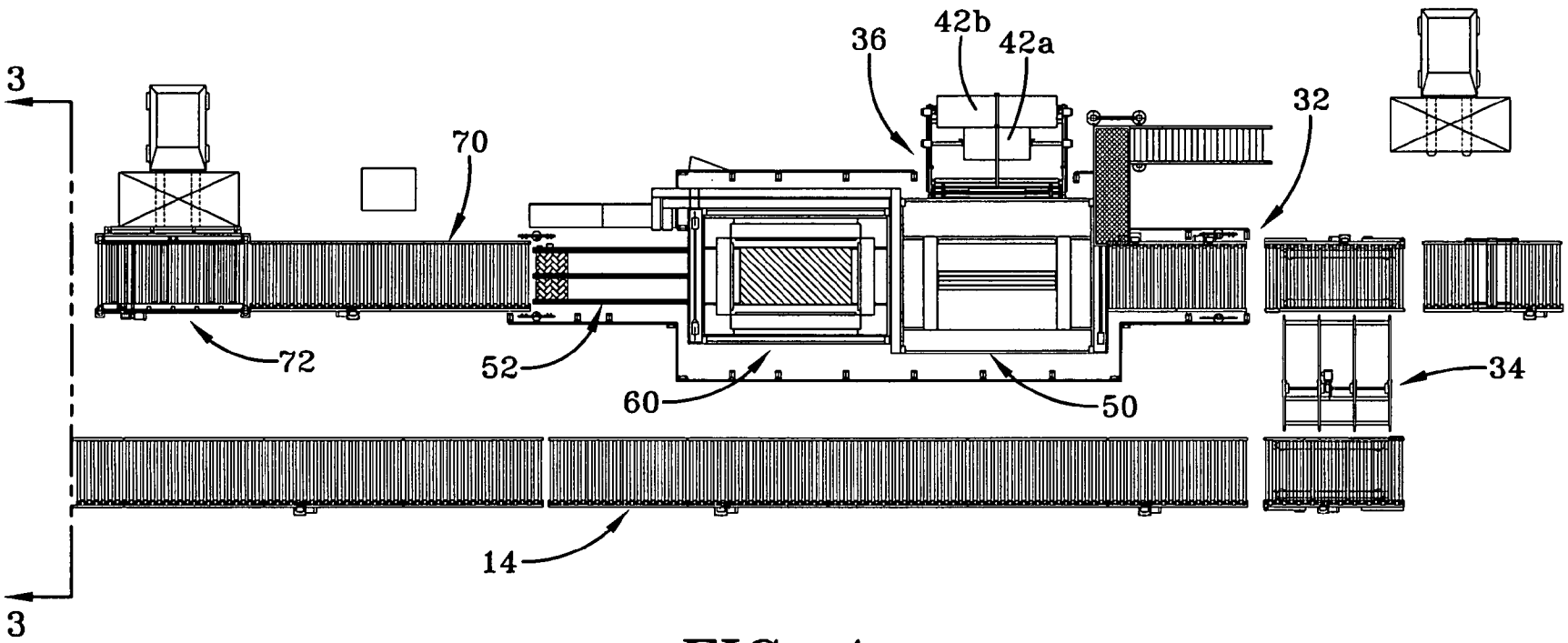
FIG. 4 is a fragmentary top schematic view of a continuation of the factory line of FIG. 3.

In one or more embodiments, due to space constraints, it may be desirous to employ a second conveyor 32. As shown in FIG. 4, second conveyor 32 may be powered and parallel to first conveyor 14. A second chain conveyor 34 may transfer stacks 18 from first conveyor 14 to second conveyor 32 in a manner known in the art.

Stacks 18 are delivered to a shrink wrap station 36 by either first conveyor 14 or, as in the present embodiment, by second conveyor 32. Shrink wrap station 36 covers each stack 18 with a tight, form-fitting membrane, thereby creating self-contained bundles 64 of insulation panels. Shrink wrapping methods and apparatus are known in the art, as exemplified by the disclosures of U.S. Pat. No. 6,945,016 to Hannen, U.S. Pat. No. 6,837,031 to Hannen et al., U.S. Pat. No. 6,615,565 to Dekker, U.S. Pat. No. 6,532,719 to Hannen et al., U.S. Pat. No. 6,474,051 to Hannen et al., U.S. Pat. No. 6,421,983 to Lachenmeier et al., U.S. Pat. No. 6,298,636 to Lachenmeier et al., U.S. Pat. No. 5,471,818 to Hannen, U.S. Pat. No. 5,111,528 to Hannen et al., U.S. Pat. No. 5,042,235 to Hannen et al., U.S. Pat. No. 5,018,339 to Hannen et al., U.S. Pat. No. 4,877,012 to Hannen et al., U.S. Pat. No. 4,866,916 to Hannen et al., U.S. Pat. No. 4,451,233 to Lachenmeier et al., U.S. Pat. No. 4,330,265 to Lachenmeier et al., which are incorporated herein by reference. The method of the present invention may be practiced with a variety of heat-shrink wrapping apparatus and thus only general reference will be made to the shrink wrap apparatus components.

A wrap material 40, which may be referred to as wrap 40, may be used by shrink wrap station 36 to cover stacks 18. Wrap 40 may include a heat shrinkable material wherein the application of heat causes a reduction in size. Due to the physical nature of wrap 40, and because it may be described as a relatively thin material, the reduction in size may be realized primarily along the long axes and not in thickness. In one or more embodiments, wrap 40 may be a thermoplastic material such as a polyethylene. In one or more embodiments, wrap 40 may be from about 0.001 inches to about 0.010 inches thick, in other embodiments from about 0.002 to about 0.008 and in other embodiments from about 0.003 inches to about 0.004 inches thick. In one or more embodiments, wrap 40 may be a single membrane. In other embodiments, wrap 40 may be at least 0.001 inches thick, in other embodiments wrap 40 may be at least 0.003 inches thick, and in other embodiments wrap 40 is at least 0.007 inches thick; in these or other embodiments wrap 40 may be less than 0.010 inches thick, in other embodiments wrap 40 may be less than 0.005 inches thick and in still other embodiments wrap 40 may be less than 0.004 inches thick.

Figure 5:
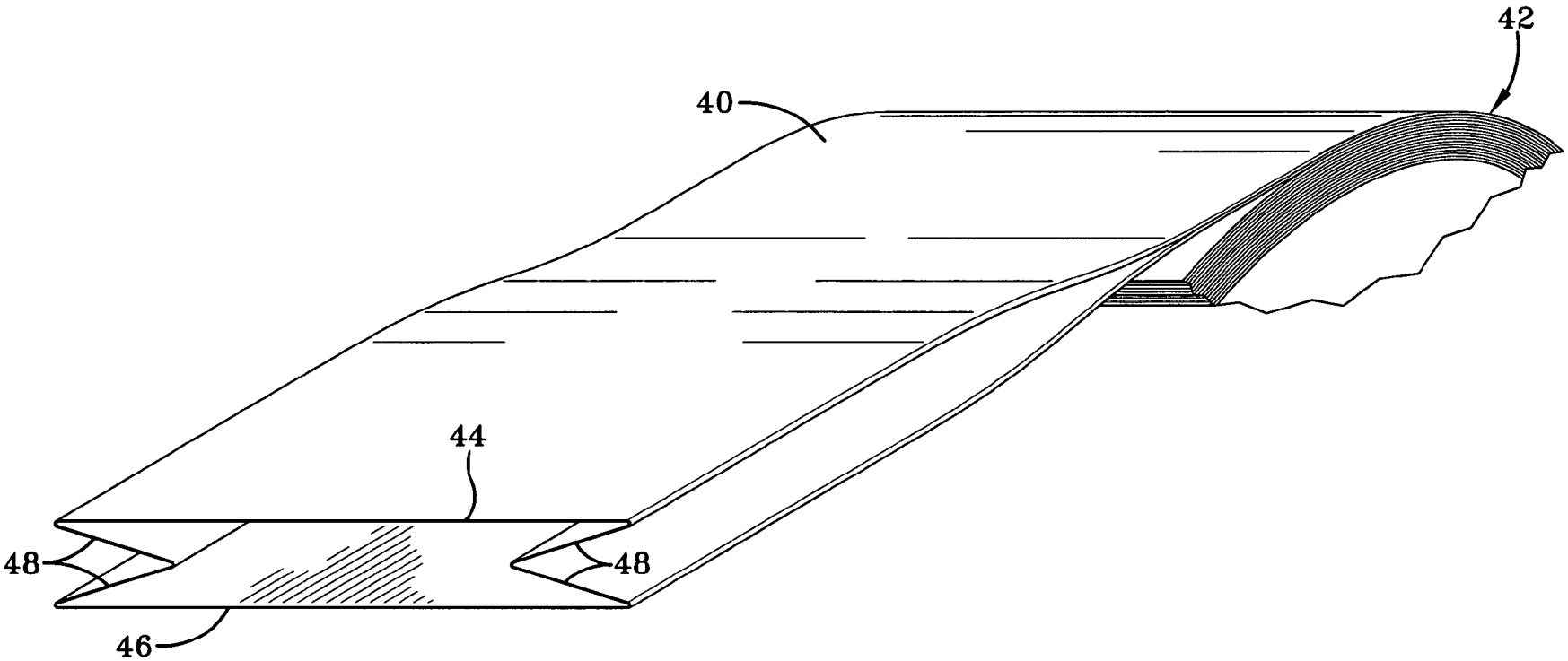
FIG. 5 is an isometric view of the wrap material employed in one or more embodiments of the present invention.
Figure 6:
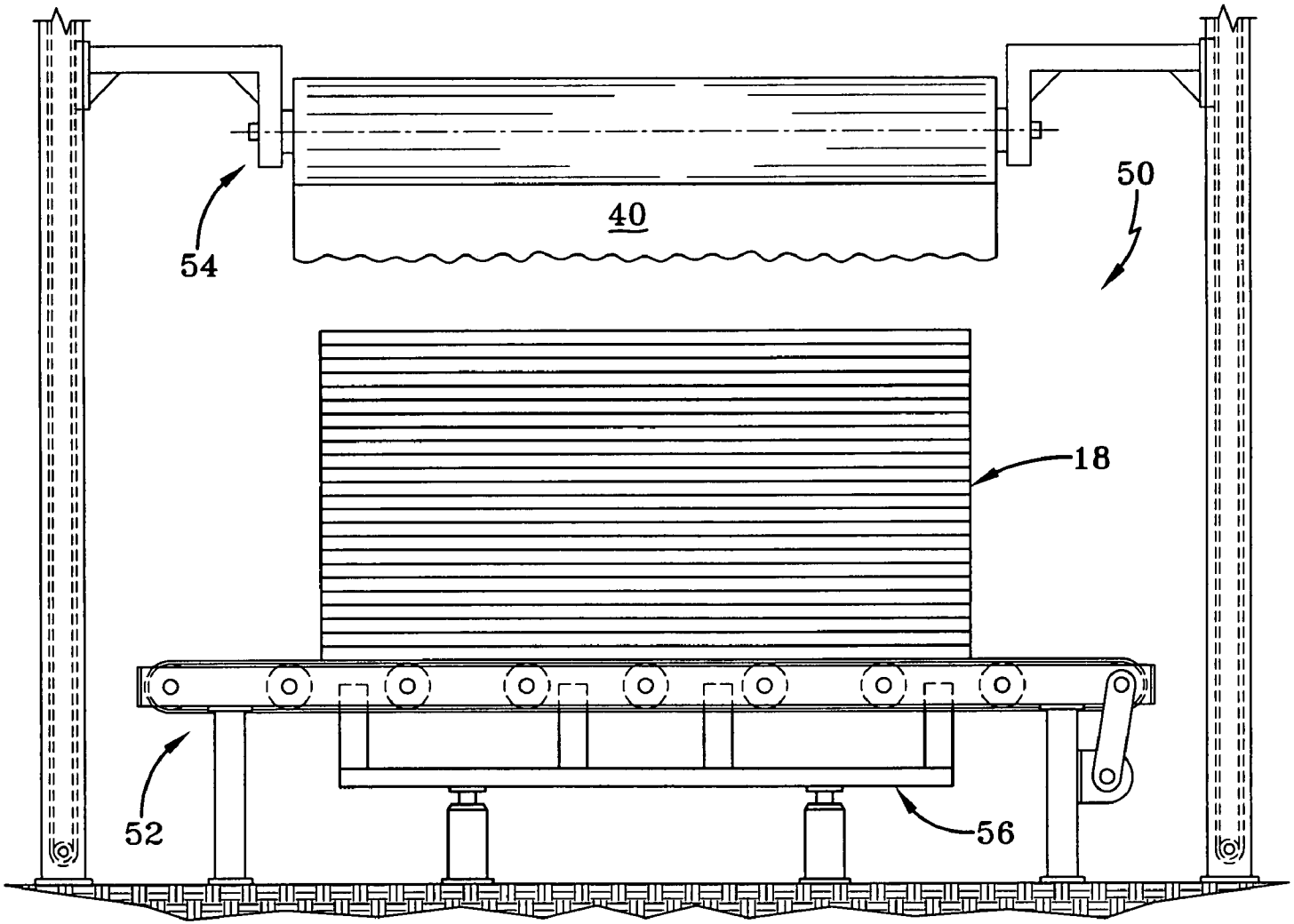
FIG. 6 is a fragmentary side elevational view of the first stage of a shrink wrapping station including a stack of panels prior to application of wrap material.

As shown in FIG. 5, wrap 40 may be provided to shrink wrap station 36 in the form of a collapsed hollow sleeve. Further, wrap 40 may be supplied on large circumference roles 42 that supply a length of wrap material 40 sufficient for numerous shrink wrapping operations before a re-supply is necessary. In one or more embodiments, wrap 40 may, in cross-section, include a top portion 44, and an opposed bottom portion 46. A pair of folded portions 48 interconnect bottom and top portions 44 and 46. As will become evident, folded portions 48 provide advantageous seam characteristics during the heat shrinking process. Referring now to FIG. 4, in one or more embodiments, two roles 42 may be provided, which are of different size to cover different panel sizes. For example, one role 42*a* may be sized to fit a 4 foot by 4 foot insulation board, and a second role 42*b* may be sized to fit a 4 foot by 8 foot insulation board.

Figure 7:
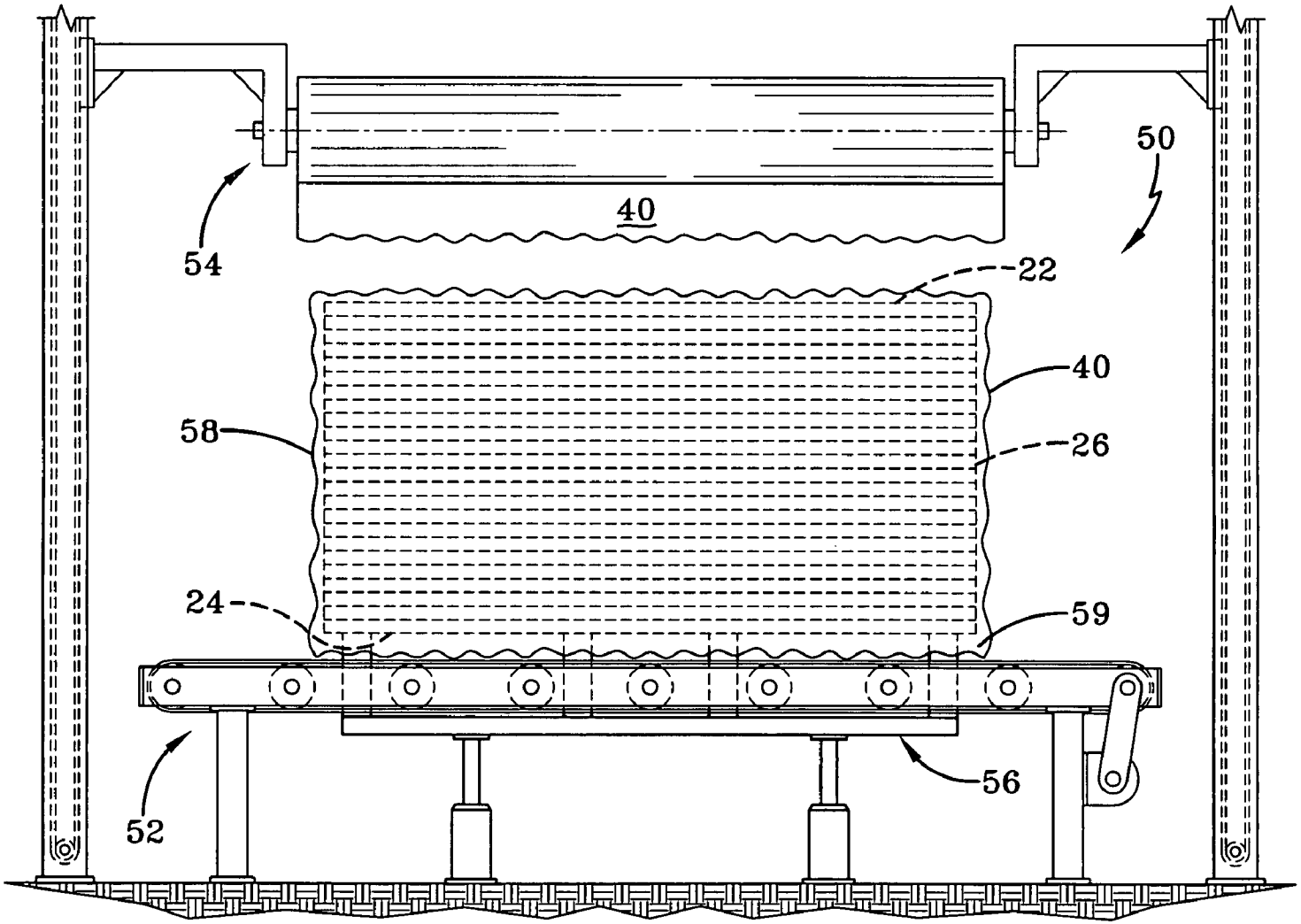
FIG. 7 is a fragmentary side elevational view of the first stage of the shrink wrapping station wherein the stack of panels has a wrap material disposed thereon.

Shrink wrapping station 36 includes a first stage 50, wherein individual stacks 18 are covered loosely by wrap 40. At first stage 50, stack 18 may be transferred from second conveyor 32 to a chain conveyor 52 that thereafter positions stack 18 under a wrap material supplier 54. Stack 18 may then be lifted above chain conveyor 52, by for example, a hydraulically or mechanically actuated frame 56. Wrap 40 may then be pulled over stack 18 from above. Prior to application of the wrap 40, the height of stack 18 may be automatically measured, and correspondingly the correct length of wrap material 40 can be automatically provided over stack 18. When the appropriate wrap length is reached, a heat bar or the like may simultaneously cut the sleeve and weld the open portion closed at the top. The resulting wrap 40, shown in FIG. 7, may be in the form of an inverted bag 58 that covers both top surface 22 and lateral sides 26 with the heat shrinkable wrap 40. As is evident from FIG. 7, wrap 40 fits loosely over the stack 18 at this point in the process. In one or more embodiments it may be advantageous to apply enough wrap material 40 so that an overhanging portion 59 extends below bottom surface of 24 of stack 18. In other words, the wrap material 40 drapes beyond bottom edge 28 and may hang below stack 18.

While held above chain conveyor 52 by frame 56, it may be advantageous to provide a vacuum proximate to bottom surface 24. The vacuum may be provided, for example, by a fan or by any other means known in the art. In any event, the application of the vacuum proximate to bottom surface 24 causes the overhanging portions 59 of bag 58 to pull inwardly toward bottom surface 24. In other words, the vacuum effectively tucks overhanging portions 59 underneath stack 18, creating folded-under portions 61. Still further, the vacuum may advantageously remove some air from between bag 58 and stack 18, making the shrinking process easier. Stack 18 may then be lowered back onto chain conveyor 52 while still maintaining the vacuum. Thereafter, conveyor 52 maintains the folded-under portions 61 in position. In other words, folded-under portions 61 of wrap 40 are held between conveyor 52 and stack 18. Chain conveyor 52 may then transport the loosely covered stack 18 to a second shrink wrap stage 60.

Figure 8:
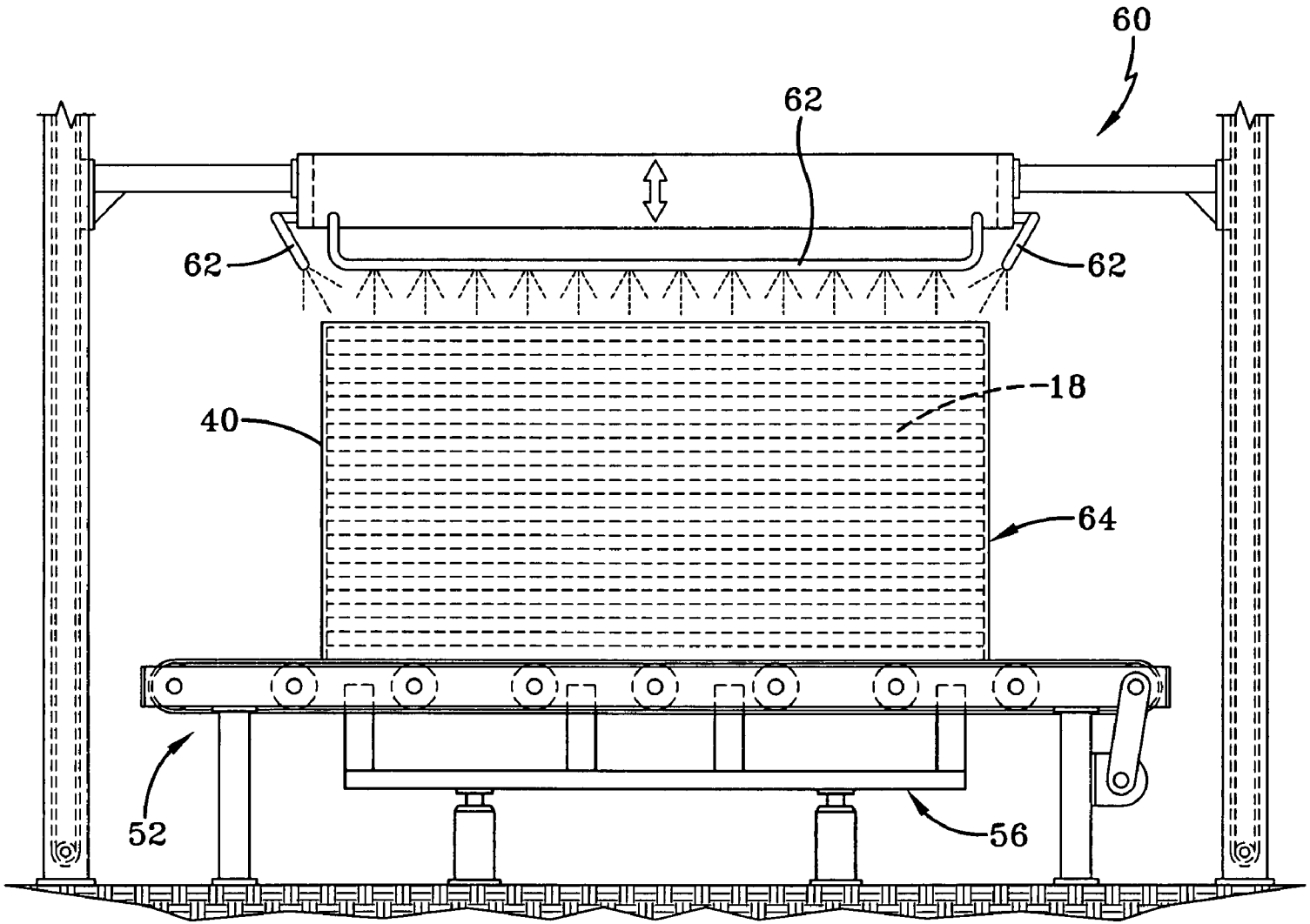
FIG. 8 is a fragmentary side elevational view of the second stage of the shrink wrapping station showing heat is applied to the wrap material on the stack of panels.

In second stage 60, wrap 40 can be caused to shrink around stack 18 by the application of heat thereto. In one or more embodiments, a heat ring 62 may be provided that surrounds the bag-covered stack 18, and supplies an inwardly directed flow of heat. Heat ring 62 is movable vertically and may direct the heated air at any exterior surface of stack 18. Heat ring 62 may move downwardly and/or upwardly a predetermined number of passes, incrementally shrinking wrap 40 during each pass. In one embodiment, heat ring 62 completes the shrinking process after one downward and upward pass (cycle), thereby achieving reduced cycle time. Also, heat ring 62 may direct air at bottom surface 24 and bottom edge 28. The application of heat to folded-under portions 61 of wrap 40, and the shrinking thereof, cause wrap 40 to clamp stack 18 between folded-under portions 61 and the portion of wrap 40 proximate to top surface 22. Additional shrinking draws tension on wrap 40, tightening it against the sides 26 and top 22 of stack 18. As shown in FIG. 8, the resulting wrap 40 closely conforms to stack 18, forming a tight form-fitting cover. Advantageously, in one or more embodiments, top edges 30 are closely covered with heat shrinkable materials with few exposed wrinkles. In one or more embodiments wrap 40 may be substantially flush against lateral sides 26 after application of heat. In these or other embodiments, wrap 40 may be substantially flush against top surface 22 after application of heat. In these or other embodiments, wrap 40 may be substantially flush against a portion of bottom surface 24 after application of heat. Further, after heat shrinking, top surface 22, lateral sides 26, and at least a portion of bottom surface 24 include a wrap material 40 closely formed thereto. Wrap 40 provides vertical and lateral support to maintain stack 18 in the form of a bundle 64. Bundle 64 is self contained and may be easily stored or transported while wrap 40 protects the integrity of individual boards.

Figure 9:
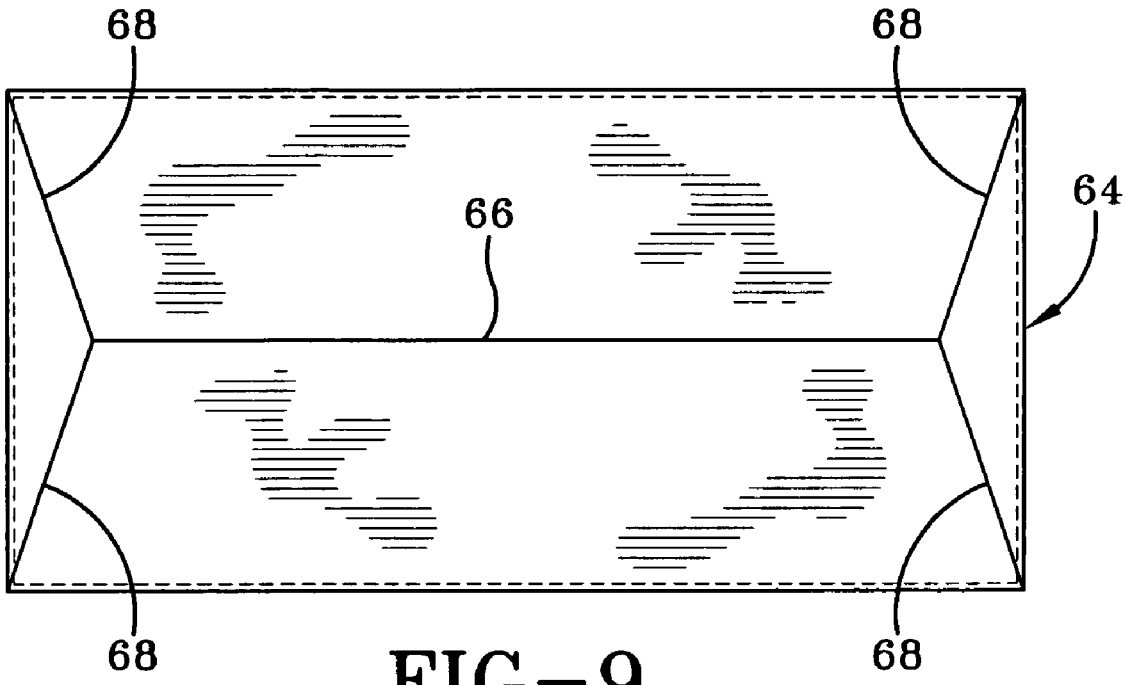
FIG. 9 is a top plan view of the bundle of wrapped panels after application of heat.
Figure 10:
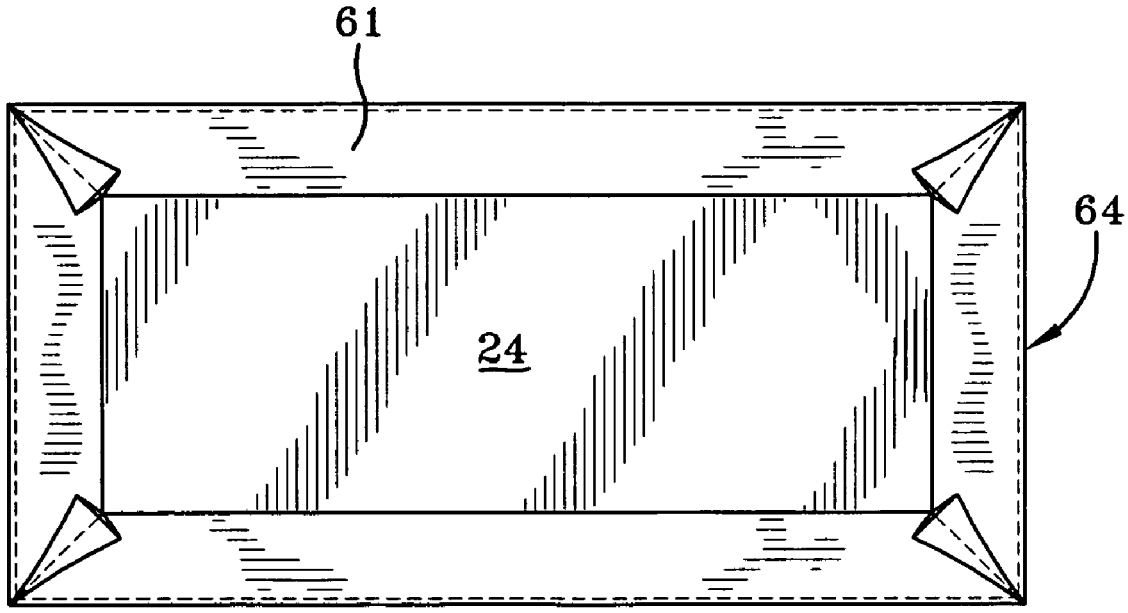
FIG. 10 is a bottom plan view of the bundle after application of heat.

Further, it should be appreciated that when wrap 40 is provided in the folded-edge orientation shown in FIG. 5, a cross-lapped surface can be formed at the top of bundle 64. As shown in FIG. 9, a seam 66 results where the heat bar cut and sealed wrap 40 in first stage 50. Further, four folded edges 68 extend from seam 66 to the four corners of stack 18. This tightly folded cross-lapped surface is advantageously minimizes the formation of wrinkles or lose flaps at the top of bundle 64. Further, as is evident from FIG. 10, the bottom of bundle 64 includes folded-under portions 61, which may be firmly positioned under bottom surface 24 of stack 18.

Thus, in this manner, a heat shrink wrap 40 can be applied to a stack 18 of insulation panels 10. The resulting bundles 64 may then exit wrapping station 36 via a third conveyor 70. Third conveyor 70 may be powered and transfer bundles 64 to a spacer application station 72.

Spacer application station 72, shown in FIG. 11, may include a modified conveyor portion 74 having a plurality of movable lifts 76 positioned between and below a plurality of individual rollers 78. The lifts 60 can be adapted to carry spacers 80 thereon, which may in turn be adapted to attach to bottom surface 24 of bundle 64. In one or more embodiments, spacers 80 may extend substantially the entire width of bundles 64, contacting both insulation panels 10 and wrap 40. In other embodiments, spacers 80 may include a foamed plastic material. Spacers 80 may allow fork lifts to easily insert a lift arm under bundle 64. Further, spacers 80 may prevent bundle 64 from directly contacting the ground. This feature may be advantageous at a job site where bundles 64 might be stored in areas exposed to dirt, water and other damaging elements.

Prior to receiving a bundle 64 in modified conveyor portion 74, lifts 76 may be raised, enabling an operator to place a spacer 80 on at least two lifts 76. Lifts 76 may then be lowered to allow bundle 64 to advance over the modified conveyor portion 74. Lifts 76 may then extend upwardly, thereby bringing spacers 80 into contact with bottom surface 24 of bundles 64. Spacers 80 may include an adhesive side 82, which faces upwardly, towards bundle 64. Upon contact with bottom surface 24, spacer 80 may be adhered to bundle 64.

Thus, in this manner, spacers 80 may be applied to bottom surface 24 of bundle 64. The step of raising bundle 64 additionally provides clearance for a forklift truck to insert lifting arms underneath. Thus, after bundle 64 is raised, thereby securing spacer 80 thereto, the forklift can remove the bundle.

In one or more embodiments, a first bundle 64*a* is removed from lift 76 by a forklift after application of spacers 80. The forklift thereafter remains at the spacer application station 72 as a second bundle 64*b* is received in the spacer application station 72. Spacers 80 may then be applied to second bundle 64*b* as described above. First bundle 64*a* may then be raised by the forklift and placed on top of second bundle 64*b*, as shown in FIG. 11. The forklift operator may then insert the lift arms under second bundle 64*b*, which may be raised by lifts 76 and thereafter carry a pair of bundles 64 simultaneously. Bundles 64*a* and 64*b* may thereafter be carried to a storage area, or directly to a truck for shipment. It should be appreciated that because bundles 64 are self-contained, the use of pallets or other support means, is not necessary. The use of spacers 80 further eliminates the need for pallets because spacers 80 maintain stacks 18 off the ground and away from contaminates.

Bundles 64 are prepared to exit the manufacturing facility upon removal from spacer application station 72 and may be taken directly to a vehicle 84 or may first be stored. As should be evident, bundles 64 are stackable and may thus be stored or transported while vertically stacked. Bundles 64 may be transported by trucks, as needed, to construction sites. Practice of this invention, however, is not limited to the use of trucks inasmuch as other transport vehicles, such as trains, may be used. In one or more embodiments, the vehicles employed for transport include flatbed trucks. In one or more embodiments, the flatbed truck include an approximately 8 foot wide bed. Thus, for example, if transporting insulating board that is 8 feet long and 4 feet wide, the most efficient method of loading the truck is to place the long axis of each bundle 64 parallel with the long axis of the truck. In this orientation two bundles 64 may be placed side by side as shown in FIG. 13.

As earlier discussed, bundles 64 may be vertically stacked on vehicle 84, but in no case is it desirous to exceed a total height of 13 feet 6 inches, which is a national shipping regulation. Thus, following the earlier example, if 48 inch tall bundles are produced, 2 bundles may be vertically stacked and still remain below the regulated height.

It should be appreciated that the bed portion of vehicle 84 need not provide restraining walls. In this situation, bundles 64 may advantageously be further secured to vehicle 84 prior to leaving the factory. In one or more embodiments, bundles 64 may be secured by one or more straps 86. Straps 86 may be secured in any known manner. In one or more embodiments, straps 86 may be thrown over bundles 64 from one side of truck 84 to the other. Each end may then be secured and tightened, thereby securing bundles 64 to flatbed truck 84. In other embodiments, a crane or forklift may carry the straps over bundles 64 stacked on flatbed truck 84.

Thus, vehicle 84 may depart with the load of bundles 64 secured thereto. While it is historically desirable that vehicle 84 travel less than 500 miles, in order to avoid damaging insulation panels 10, it has been shown that practice of the present invention may allow for travel exceeding 500 miles. Specifically, because the wrap 10 forms a close form fit to stacks 18, no "wrinkles" or "flaps" are exposed to the winds at highway speed, which may cause damage or failure of the wrap material 40.

Bundles 64 may be removed from vehicle 84 by any known means upon arrival at a job site. For example, a fork lift may be employed to remove bundles 64 from the truck. In one or more embodiments, bundles 64 may be taken directly to the roof of a building, or may be stored on the ground until needed. Wrap 40 may advantageously continue to protect stacks 18 during storage at the job site and during transfer to the roof inasmuch as wrap 40 may be substantially water resistant and spacers 80 may maintain stack 18 away from harmful contaminates.

Thus, when insulation panels are wrapped and transported in manner described above, it should be evident that tarping is not required for transportation. The wrap material disclosed herein provides a protective membrane against wind and other elements, negating the need for additional protection. The elimination of the tarping step provides several benefits. It is no longer necessary for the truck operator to climb to dangerous heights to lay the tarp. Time and money is saved because of the elimination of a lengthy loading and unloading step. Finally, this method provides the same or better protection level as that provided by prior art methods.

Thus it should be evident that the method of transporting insulation panels disclosed herein is an improvement in the art. Various modifications and alterations that do not depart from the scope and spirit of this invention will become apparent to those skilled in the art. This invention is not to be duly limited to the illustrative embodiments set forth herein.

What is claimed is:

1. A method of transporting insulation panels to a location, the method comprising:

providing a plurality of insulation panels;

positioning a predetermined number of said insulation panels into a stack, said stack having a top surface, lateral side surfaces and a bottom surface;

covering said stack with a heat shrinkable material, wherein said heat shrinkable material covers said top surface and said lateral side surfaces, at least a portion of said material extending below an intersection between said bottom surface and said lateral side surfaces;

heating said heat shrinkable material, thereby shrinking said heat shrinkable material substantially flush against said lateral side surfaces, wherein said step of heating further includes the steps of providing a heat ring which directs heated air radially inward; positioning said ring around said stack; and moving said ring upward and downward between said top and said bottom of said lateral side surfaces;

loading said stack on a vehicle; and moving said vehicle with said stack to a remote location.

2. The method of claim 1, wherein said panels include isocyanurate insulation boards.

3. The method of claim 1, where said heat shrinkable material is substantially flush against said top surface.

4. The method of claim 3, wherein said panels have a length being from about 4 feet to about 8 feet.

5. The method of claim 1, wherein said panels have a thickness being from about ½ inch to about 4 inches.

6. The method of claim 1, wherein said stack is from about 46 inches to about 50 inches high.

7. The method of claim 1, wherein said heat shrinkable material includes polyethylene.

8. The method of claim 1, wherein said heat shrinkable material has a thickness of about 2 mils to about 8 mils.

9. The method of claim 1, wherein the step of covering said stack with a heat shrinkable material further includes the steps of moving a sleeve of said heat shrinkable material over said stack from a top of said lateral side surfaces to a bottom of said lateral side surfaces; cutting said sleeve at a location above said top surface; and heat sealing said sleeve proximate said top surface.

10. The method of claim 1, wherein said step of heating said heat shrinkable material results in a self contained stack of insulation panels that is devoid of a pallet.

11. The method of claim 1 further comprising the step of drawing a vacuum proximate to said bottom surface to pull inward said heat shrinkable material which extends beyond said lateral side surfaces.

12. A method of transporting insulation panels to a location, the method comprising:

providing a plurality of insulation panels;

positioning a predetermined number of said insulation panels into a stack, said stack having a top surface, lateral side surfaces and a bottom surface;

covering said stack with a heat shrinkable material, wherein said heat shrinkable material covers said top surface and said lateral side surfaces, at least a portion of said material extending below an intersection between said bottom surface and said lateral side surfaces;

heating said heat shrinkable material, thereby shrinking said heat shrinkable material substantially flush against said lateral side surfaces:

applying a plurality of spacers to said bottom surface of said stack, wherein said plurality of spacers are made of a foamed plastic material;

loading said stack on a vehicle; and moving said vehicle with said stack to a remote location.

13. The method of claim 12, wherein the step of applying a plurality of spacers to said bottom surface further comprises providing a conveyor having a plurality of lifts positioned between and below a plurality of conveyor rollers; placing said spacers on said lifts, said spacers having an adhesive side which faces upwardly; and raising said lifts to bring said spacers and said stack into contact and elevate said stack above said conveyor.

14. The method of claim 13, further comprising the step of removing said stack from said lifts with a forklift; applying spacers to a second stack; placing said stack on top of said second stack; and simultaneously removing said stack and said second stack from said lifts.

15. The method of claim 1, further comprising the step of securing said stack to said vehicle including providing a strap; throwing said strap from one side of said vehicle to another side of said vehicle; and securing each end of said strap to said vehicle.

16. The method of claim 1 further comprising the step of removing said stack from said vehicle and storing said stack on the ground until needed.

17. The method of claim 1, further comprising the step of removing said stack from said vehicle and transporting said stack directly to a roof of a building.

18. The method of claim 1, wherein said insulation panels comprise an open celled foam.

19. The method of claim 12, wherein said step of heating said heat shrinkable material results in a self contained stack of insulation panels that is devoid of a pallet.

20. The method of claim 12, wherein said insulation panels comprise an open celled foam.

21. The method of claim 12, further comprising the step of securing said stack to said vehicle including providing a strap; throwing said strap from one side of said vehicle to another side of said vehicle; and securing each end of said strap to said vehicle.

22. The method of claim 21, further comprising the step of removing said stack from said vehicle and storing said stack on the ground until needed.

23. The method of claim 21, further comprising the step of removing said stack from said vehicle and transporting said stack directly to a roof of a building.

24. The method of claim 12, wherein the step of covering said stack with a heat shrinkable material further includes the steps of moving a sleeve of said heat shrinkable material over said stack from a top of said lateral side surfaces to a bottom of said lateral side surfaces; cutting said sleeve at a location above said top surface; and heat sealing said sleeve proximate said top surface.

25. The method of claim 12, wherein said panels include isocyanurate insulation boards.

26. The method of claim 12, where said heat shrinkable material is substantially flush against said top surface.

27. The method of claim 26, wherein said panels have a length being from about 4 feet to about 8 feet.

28. The method of claim 27, wherein said panels have a thickness being from about ½ inch to about 4 inches.

29. The method of claim 28, wherein said stack is from about 46 inches to about 50 inches high.

30. The method of claim 12, wherein said heat shrinkable material includes polyethylene.

31. The method of claim 30, wherein said heat shrinkable material has a thickness of about 2 mils to about 8 mils.

32. The method of claim 12, wherein said step of heating further includes the steps of providing a heat ring which directs heated air radially inward; positioning said ring around said stack; and moving said ring upward and downward between said top and said bottom of said lateral side surfaces.

33. The method of claim 32, further comprising the step of drawing a vacuum proximate to said bottom surface to pull inward said heat shrinkable material which extends beyond said lateral side surfaces.

* * * * *